US005272827A

United States Patent [19]

Vang et al.

[11] Patent Number: 5,272,827

[45] Date of Patent: Dec. 28, 1993

[54] SHOTGUN BARREL

[76] Inventors: Hans J. Vang, 340 Old Mill Rd., Santa Barbara, Calif. 93110; Carl D. Calos, 1700 E. College Ave., Lompoc, Calif. 93436

[21] Appl. No.: 985,328

[22] Filed: Dec. 4, 1992

Related U.S. Application Data

[62] Division of Ser. No. 856,512, Mar. 24, 1992, Pat. No. 5,249,385.

[51] Int. Cl.[5] ..... F41A 21/18; F41A 21/40

[52] U.S. Cl. ..... 42/79; 89/14.3; 89/14.05

[58] Field of Search ..... 89/14.05, 14.3, 16, 89/15; 42/76.01, 76.02, 79; 29/1.1, 1.11

[56] References Cited

U.S. PATENT DOCUMENTS

| | | | |
|---|---|---|---|
| 14,597 | 4/1856 | Buckel . | |
| 157,008 | 11/1874 | Kerr . | |
| 618,901 | 2/1899 | Peterson . | |
| 863,431 | 8/1907 | Parker . | |
| 1,858,560 | 5/1932 | Rosenstiel . | |
| 2,054,132 | 9/1936 | Lewis . | |
| 2,323,306 | 7/1943 | Campbell . | |
| 2,742,821 | 4/1945 | Sweetman . | |
| 2,972,800 | 2/1961 | Sterba et al. | 29/1.1 |
| 3,138,991 | 6/1964 | Malther | 89/14.3 |
| 4,058,925 | 11/1977 | Linde et al. | 29/1.1 |
| 4,071,971 | 2/1978 | Tornas . | |
| 5,155,291 | 10/1992 | Dabrowski | 89/14.05 |

FOREIGN PATENT DOCUMENTS

| | | | |
|---|---|---|---|
| 469303 | 12/1928 | Fed. Rep. of Germany | 29/1.11 |
| 1053287 | 3/1959 | Fed. Rep. of Germany | 29/1.1 |
| 364168 | 8/1906 | France . | |
| 468883 | 7/1914 | France . | |
| 615566 | 1/1927 | France | 89/14.3 |
| 912871 | 8/1946 | France . | |
| 462064 | 2/1951 | Italy . | |
| 854516 | 11/1960 | United Kingdom . | |

OTHER PUBLICATIONS

English translation of French pat. #615,566 (SteFafno).

*Primary Examiner*—Stephen M. Johnson
*Attorney, Agent, or Firm*—John P. O'Banion

[57] ABSTRACT

A short length shotgun barrel exhibiting high accuracy and reduced felt recoil, and providing for interchangeability of loads containing shot pellets and slugs. The barrel includes an elongated and tapered forcing cone, a backbored region between the muzzle and the forcing cone, venting ports positioned in the area of the muzzle, and a muzzle region of smaller diameter than the backbored region. The nominal inside diameter of the barrel from the forcing cone to a point adjacent the muzzle is greater than the muzzle diameter. Radially projecting ports are provided in the transition area of the backbored region near the muzzle end of the barrel, and the area surrounding the venting ports is roughened. The forcing cone is elongated and tapered down from the chamber toward the muzzle end of the barrel.

7 Claims, 3 Drawing Sheets

SHOTGUN BARREL

This application is a division of our copending application Ser. No. 07/856,512 filed on Mar. 24, 1992 now U.S. Pat. No. 5,249,385.

BACKGROUND OF THE INVENTION

1. Field of the Invention

This invention pertains generally to shotguns, and more particularly to improving the accuracy of shorter length shotgun barrels, reducing felt recoil, and providing for interchangeability of shot pellets and slugs in a single barrel.

2. Description of the Background Art

Conventional shotguns employ barrels of various configurations. Most notable are variations in chokes to change the pattern of the shot pellets. Barrel lengths vary also, since the amount of recoil which is felt by the user decreases as the barrel length is increased. Accuracy is also improved by using longer barrels.

A shotgun, however, is generally a short range weapon. As smaller shot is used, a smaller effective range results. The tighter the shot pattern, the more accurate the shotgun is at longer ranges. The size of the pattern is a function of several variables which include the degree of choke if any, the size of the shot, and the load.

Various attempts at improving shotgun barrels, reducing recoil, and increasing accuracy have been made over the years. For example, French 912,871 discloses a modified choke. Italian 462,064 discloses an over/under barrel where one barrel contains a choke. British 854,516 discloses a barrel configuration for a recoilless rifle in which the barrel contains multiple tapers to serve as a seat for the cartridge case, as well as to create a smaller diameter chamber for the projectile. British 9,208 discloses a rifled shotgun barrel having an expanded chamber near the muzzle end. British 9,164 discloses a rifled barrel of similar configuration to that shown in British 9,208. British 4,294 discloses a barrel having two conically shaped sections in which the inside of the barrel tapers and then flares toward the muzzle end. French 364,168 discloses a shotgun barrel having a tapered section on the muzzle side of the forcing cone. French 468,883 discloses a shotgun barrel having a constricted forcing cone and a larger diameter barrel.

U.S. Pat. No. 2,323,306 issued to Campbell on Jul. 6, 1943, discloses a saluting tube for blank shot shells which includes both tapered and flared portions. The purpose of this configuration is to increase the pressure build up in the barrel and to make more noise upon firing. U.S. Pat. No. 2,742,821 issued to Sweetman on Apr. 24, 1956, discloses a venting technique for a tapered bore gun. The tapered bore is used with a deformable projectile. The vents relieve pressure on the cartridge case to prevent mutilation. U.S. Pat. No. 1,858,560 issued to Rosenstiel on May 17, 1932, discloses a shotgun barrel in which the inner diameter toward the muzzle end is less than the breach end, and then flares out at the muzzle. This modification serves retard the wads and explosive gasses to prevent them from interfering with the passage of the shot. U.S. Pat. No. 14,597 issued to Buckel & Dorsch on Apr. 8, 1856, discloses a shotgun barrel having an undulating inner diameter. U.S. Pat. No. 4,071,971 issued to Tornas on Feb. 7, 1978, discloses a shotgun barrel having grooved rifling near the muzzle end, with the inner diameter of the barrel tapering and then flaring in the area of the grooved rifling. U.S. Pat. No. 157,008 issued to Kerr on Nov. 17, 1874, discloses a gun barrel with an enlarged bore covering approximately one-third of the overall barrel length, the enlargement occurring near the muzzle end. U.S. Pat. No. 863,431 issued to Parker on Aug. 13, 1907, discloses a barrel which tapers from the chamber toward the muzzle, the angle of the taper changing radically in the area of the muzzle, and then flaring out again near the muzzle opening. U.S. Pat. No. 2,054,132 issued to Lewis on Sep. 15, 1936, discloses a shotgun barrel having two sections which taper in opposite directions. U.S. Pat. No. 618,901 issued to Peterson on Feb. 7, 1899, discloses a shotgun barrel which is ported near the muzzle end.

The foregoing approaches, however, are directed to standard length barrels and hunting or target applications. In a combat situation, police officers and federal agents often require a short barrelled weapon that can be easily handled or concealed. Barrel lengths of approximately 48 cm or less are often referred to as "riot" shotguns and provide much greater firepower than a pistol. However, as the distance to the target increases, the shot become more dispersed and accuracy suffers. Also, because a shorter barrel weighs less, there is less weight to cushion the recoil which results from the high power of a shot shell load. In addition, in order to change from using a load containing shot pellets to a load containing solid slugs in a combat situation, it is often necessary to change barrels in order to maintain accuracy due to the differing characteristics of the loads.

Therefore, there is a need for a short barrel for combat and law enforcement use that achieves a high degree of accuracy with low recoil characteristics, as well as provides for interchangeability between shot shell loads and solid slugs. The present invention satisfies those needs.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

The present invention pertains generally to improvements in shotgun barrels, and more particularly to a shotgun barrel which achieves high accuracy and low recoil in shorter than conventional lengths, as well as provides for interchangeability between loads contining shot pellets and loads containing slugs without sacrificing accuracy or causing damage to the barrel.

The present invention provides for improved accuracy in smooth bore shotgun barrels with lengths of 56 cm or less, while at the same time reducing recoil and shooter recovery time in manual and automatic cycling of repeating shotguns. The invention also reduces solid projectile dispersal at ranges beyond 23 meters as compared to either conventional choked barrels or unchoked barrels of the same gauge. In addition, both shot pellet and slug loads can be used interchangeably without loss of barrel choke or risk of catastrophic failure by obstruction of the barrel.

Prior to the present invention, no known nonnadjustable, fixed choke, shotgun barrel could deliver both choked pattern densities with shot shells and allow the next round to deliver an accurate shotgun fire to the target with subsequent rounds all impacting the target area of 0.9 m×0.9 m when using 00 buckshot at 46 meters from the end of a short barrel. All previously known barrels show loss of pattern density and choke when slug loads and shot pellet loads are mixed into the firing sequence, resulting in loss of choke and wider patterns over the life of the barrel.

The present invention, however, does not suffer from loss of shot pellet accuracy over time with slugs are also used. The present invention allows, for the first time, the interchangeable use of slugs and 00 buckshot at ranges of 46 meters and beyond without requiring a change of barrel or choke tube to preserve accuracy for all projectile types found in standard ammunition. In addition, inert canisters such as those used for tear gas can also be accomodated.

The remarkable characteristics of the shotgun barrel of the present invention are achieved through the implementation of several modifications to a conventional barrel. By means of clarification and not limitation, these modifications can be categorized as backboring, porting, and elongating and tapering the forcing cone.

The barrel of the present invention includes a backbored section wherein the nominal inside diameter of the barrel is increased from the area of the forcing cone to within approximately 12 mm to 80 mm from the muzzle. This technique results in a reduction of deformation of the shot pellets thereby yielding a more accurate flight path. The cup and wad are slowed upon discharge, allowing the shot cluster to exit the barrel ahead of the cup and wad to yield a denser pattern and reduce "felt" recoil. Therefore, the cup and wad do not interfere with the shot cluster upon discharge. This technique overcomes the deficiencies in most short barrel shotguns which have a cylinder bore choke of zero percent reduction and which produce a wide pattern. The present invention, by increasing the inside diameter of the barrel ahead of the muzzle, creates a reduction is the discharge diameter and effectively creates a choke-like discharge port. This condenses the shot string as it exists the muzzle and produces a pattern similar to a full choke.

A series or patterns of venting ports is machined through the barrel in the backbored region starting at approximately 12 mm to 80 mm from the muzzle and extending toward the chamber. The centerline of the ports is typically set at between 30° and 60° off vertical, although it can range anywhere from 0° to 90°. The length of the venting port pattern is typically from 25 mm to 160 mm, and may consist of a single row or several parallel rows. Preferably, the area surrounding the ports is machined to provide a roughened surface. As a result, the ports vent the discharge gases in an upward direction to counteract the rise of the muzzle, and the roughened area slows the shot cup. Higher accuracy and less "felt" recoil is thus achieved.

The forcing cone in a conventional barrel has an abrupt transition from the chamber to the bore. By increasing the length and taper of the forcing cone concentric with the chamber and bore, deformation of the shot pellets is reduced thereby yielding a more accurate flight path. In addition, the time of rearward momentum is increased, thereby yielding less "felt" recoil.

An object of the invention is to provide a high accuracy shotgun barrel in shorter lengths.

Another object of the invention is to increase the tightness of the shot pattern in short barrelled shotguns.

Another object of the invention is to provide a shotgun barrel which reduces the amount of vertical barrel deflection upon discharge of the shotgun.

Another object of the invention is to reduce deformation of shot pellets upon discharge.

Another object of the invention is to reduce the recoil felt by the user of a shotgun.

Another object of the invention is to provide a high accuracy shotgun barrel for combat and law enforcement uses.

Another object of the invention is to provide a shotgun barrel which can accurately fire solid slugs interchangeably with shot pellets.

Another object of the invention is to provide a shotgun barrel which can accurately fire solid slugs interchangeably with shot pellets without loss of choke or pattern in repeated firing applications.

Another object of the invention is to provide a shotgun barrel which can fire inert canisters such as for tear gas, in addition to firing shot pellets and slugs.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the barrel generally shown in FIG. 1, FIG. 2, FIG. 3 and FIG. 5. It will be appreciated that the invention may vary as to configuration and as to details of the parts without departing from the basic concepts as disclosed herein.

Figure 1:
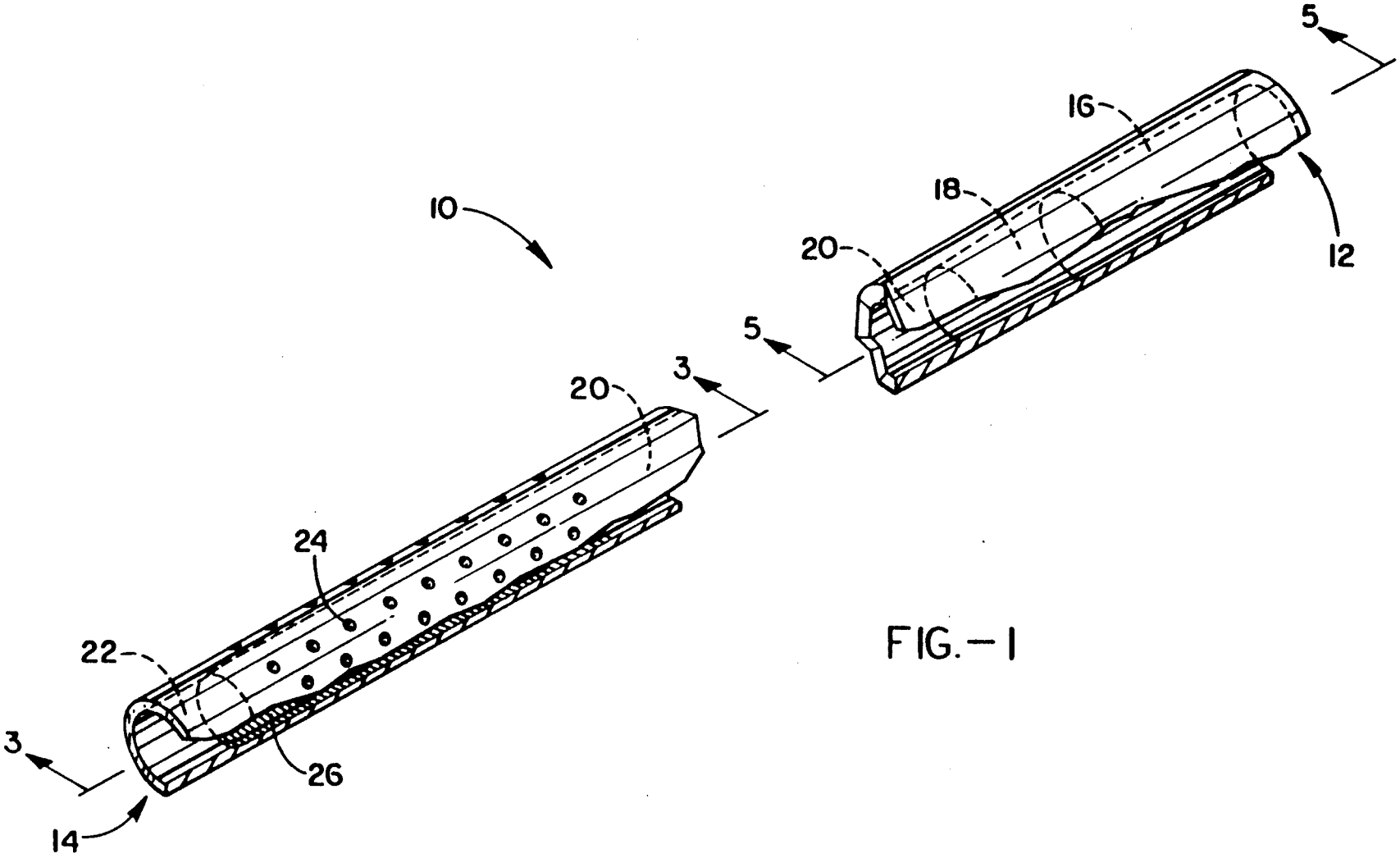
FIG. 1 is a half section view in isometric showing the gun barrel of the present invention.

Referring to FIG. 1, the apparatus of the present invention generally comprises a gun barrel 10 which includes a chamber end 12 and a muzzle end 14. Barrel 10 is typically fashioned as a tubular member from steel or the like, and generally comprises a cartridge chamber section 16, a forcing cone section 18, a barrel section 20, and a muzzle section 22, all of which provide a continuous opening between chamber end 12 and muzzle end 14. A cartridge containing slugs or shot load is inserted into cartridge chamber section 16 which is of a substantially uniform diameter throughout its length, and the slugs or shot pellets are discharged from muzzle section 22 which is also of a substantially uniform diameter throughout its length. Preferably both muzzle section 22 and cartridge chamber section 16 have smooth inner surfaces. Note also that the inner diameter of cartridge chamber section 16 is slightly greater than the inner diameter of muzzle section 22.

Figure 2:
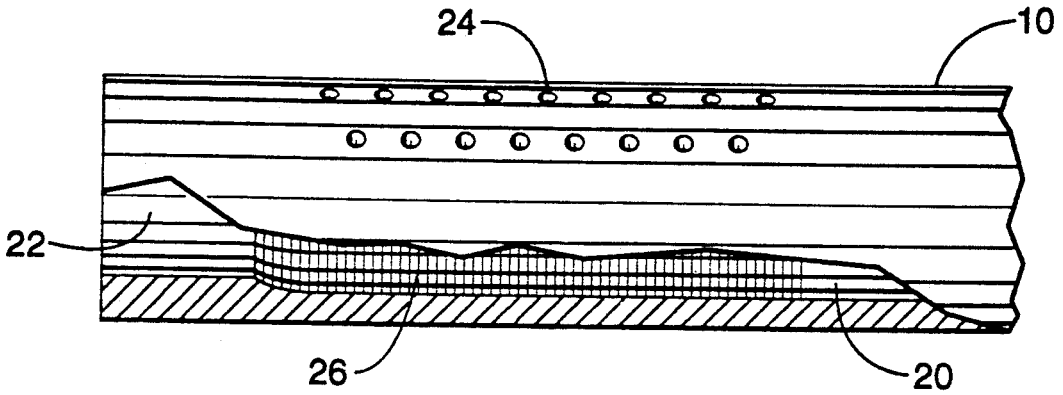
FIG. 2 is a partial cutaway of a side elevation view showing venting ports of the barrel of FIG. 1.

Referring to FIG. 1 and FIG. 2, together, a series or pattern of venting ports 24 is machined through barrel section 20 starting at approximately 12 mm to 80 mm from muzzle end 14 and extending toward chamber end 12 for a length of approximately 25 mm to 160 mm. The preferable length is approximately 50 mm, and it should be noted that it is desireable to keep venting ports 24 away from the face of the shooter.

The opening of each venting port 24 is typically 1.6 mm to 3.2 mm in diameter. While circular openings are preferred, venting ports 16 could be elliptical or slotted in their shape.

Venting ports 24 project radially from barrel 10 at angles which are preferably between 30° and 60° off the vertical centerline through barrel 10, although angles between 0° and 90° can be used. The length of the pattern of venting ports 24 is typically from 25 mm to 160 mm, and may consist of a single row or several parallel rows as shown. Where a plurality of rows is employed, venting ports 24 are typically staggered as shown to achieve closer spacing, and the rows are symmetrically placed on each side of the vertical centerline in order to provide a balanced gas discharge. The spacing between venting ports 16 in a single row is preferably 2.5 mm to 7.8 mm, whereas the spacing between rows is preferably 1.6 mm to 3.2 mm. Venting ports 24 permit the discharge gases to be vented upward and to the sides of barrel 10 in order to counteract the rise of muzzle end 14.

It should be noted that the preferred radial placement of venting ports 24 between 30° and 60° solves problems previously encountered with barrel stability. For example, if venting ports 24 were simply placed vertically, downward pressure would be too great. In order to reduce the downward pressure to acceptable levels, the number of venting ports 24 would have to be decreased to a point where their effectiveness for discharging gases would be hindered. By using the configuration disclosed herein, the unique result of obtaining both vertical and horizontal stability is achieved. This results in a barrel which retains its pointed position upon discharge and which provides for accurate placement of repetitive shots.

It should also be noted that the use of venting ports 24 could have detrimental effects on gas operated automatic or semi-automatic weapons unless additional modifications are made. Those modifications are not part of the present invention and, therefore, are not disclosed herein. Therefore, barrel 10 of the present invention is intended for use in combination with a non-gas operated shotgun.

The inner surface of the area of barrel section 20 surrounding venting ports 24 is preferably machined to provide a roughened surface 26. This can be achieved by using a sanding material or a reamer. While conventional barrels are polished smooth, roughening the inside of barrel section 20 in the area of venting ports 24 provides increased accuracy. Because the shot cup and wad will thereby be slowed in speed in relation to the discharge of the slugs or shot, they will not interfere with the discharge pattern.

Figure 3:
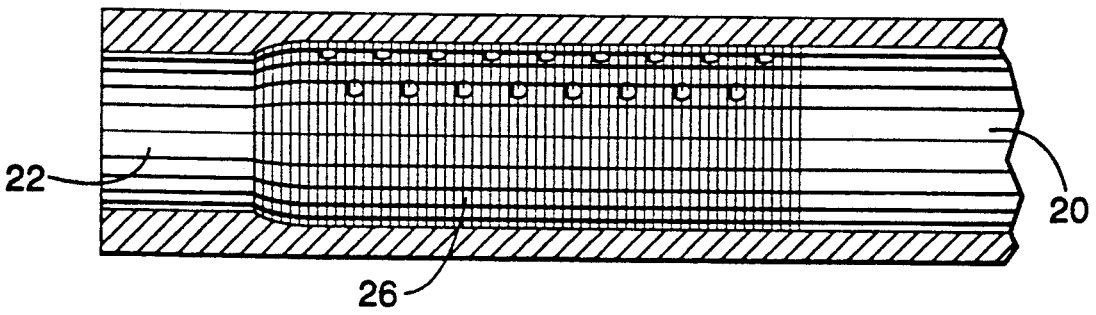
FIG. 3 is a full section view taken through line 3—3 of FIG. 1 showing the backboring configuration of the barrel of the present invention.

Referring now to FIG. 3, barrel section 20 is backbored to increase its nominal inner diameter in relation to the inner diameter of muzzle section 22. Preferably, this increase in inner diameter, which is substantially uniform along the length of barrel section 20, begins at a point approximately 12 mm to 80 mm from muzzle end 14, and continues the full length of barrel section 20 until it terminates at forcing cone section 18.

Preferrably, the backboring begins approximately 2.54 cm from muzzle end 14. If the backboring begins too close to muzzle end 14, a noticeable decrease in shot pellet or slug condensation will result and accuracy will be lost.

The amount of the increase in diameter can vary, but typically an increase between 0.127 mm and 0.305 mm over the inner diameter of muzzle section 22 is preferred. In applying this technique, it is desirable to achieve as large a diameter increase as possible without reducing the thickness of the barrel wall to a point where fatigue will result. This backboring, which is typically achieved by using a reamer, results in a reduction of deformation of the shot pellets thereby yielding a more accurate flight path. The cup and wad are slowed upon entering roughened area 26, thereby allowing the cluster of shot or slugs to exit muzzle section 20 ahead of the cup and wad to yield a denser pattern and reduce "felt" recoil. Therefore, the cup and wad do not interfere with the shot cluster upon discharge. Furthermore, this technique overcomes the deficiencies in most short barrel shotguns which have a cylinder bore choke of zero percent reduction and which result in a wide pattern. By increasing the inside diameter of barrel section 20 in relation to muzzle section 22, the change in diameter condenses the shot string as it exists the muzzle and produces a pattern similar to a conventional full choke. Note also that the transition point between muzzle section 22 and barrel section 20 is slightly tapered to provide for a more even flow of the slugs or shot pellets when they are compressed and forced into muzzle section 22.

Figure 4:
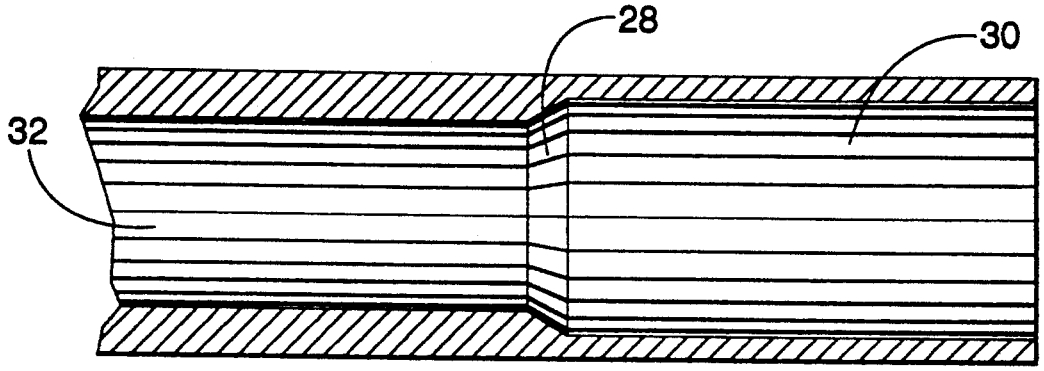
FIG.-4 PRIOR ART
FIG. 4 is a full section view showing the forcing cone of a conventional shotgun barrel.
Figure 5:
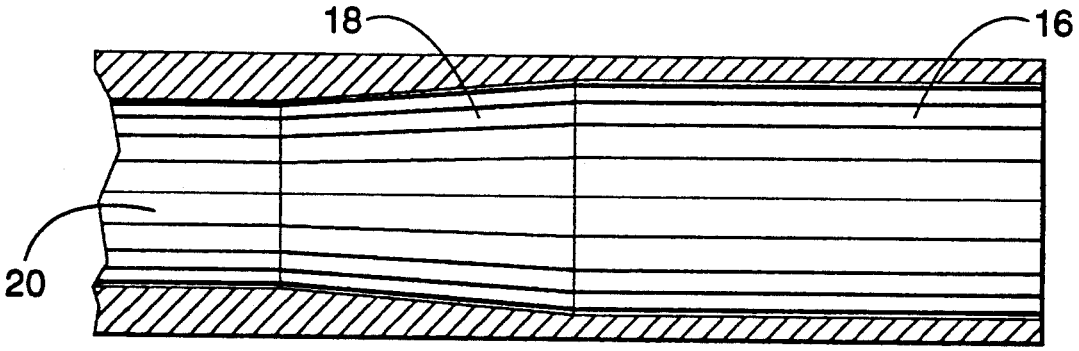
FIG. 5 is a full section view taken through line 5—5 of FIG. 1 showing the forcing cone of the barrel of the present invention.

Referring to FIG. 4, the forcing cone 28 in a conventional barrel makes an abrupt transition from the chamber 30 to the bore 32. This results in deformation of the slugs or shot pellets as they are forced from the end of the cartridge into the bore 32. Referring to FIG. 5, however, by increasing the length and taper of the forcing cone section 18 concentric with cartridge chamber section 16 and barrel section 20, there is a reduction of deformation of the slugs or shot pellets thereby yielding a more accurate flight path. In addition, the time of rearward momentum is increased, thereby yielding less "felt" recoil. This is achieved by using a tapered reamer to form a forcing cone section 18 which tapers downward from cartridge chamber section 16 toward barrel section 20. The taper length of forcing cone section is preferably between 25 mm and 80 mm, but varies as a function of the change in bore diameter between barrel section 20 and cartridge chamber section 16.

It should also be noted that, while the present invention is ideally suited where the length of barrel 10 is 48 cm or less, the methods and apparatus described herein are equally well suited for longer length barrels.

Accordingly, it will be seen that this invention provides a significantly improved shotgun barrel in which high accuracy and lower recoil can be achieved with short length barrels. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A method for improving the accuracy of a shotgun barrel of the type having a chamber, a muzzle, and a forcing cone between said chamber and said muzzle, said barrel having a bore, said barrel bore having a diameter, said barrel having an inside surface, said muzzle having a bore, said muzzle bore having a diameter, said forcing cone having a length, said forcing cone having a bore, said forcing cone bore having a diameter, comprising the steps of:

(a) elongating and tapering the forcing cone of said barrel from said chamber toward said muzzle wherein the length of said forcing cone is greater than the diameter of the forcing cone bore;

(b) increasing the bore diameter of said barrel with respect to the bore diameter of said muzzle, said increase in diameter extending from said forcing cone to a transition point near said muzzle;

(c) boring a plurality of venting ports in said barrel in an area between said said forcing cone and said transition point; and (d) roughening the inside surface of said barrel in proximity to said venting ports.

2. The method recited in claim 1, wherein said venting ports project radially at an angle of 0° to 90° with reference to a vertical center line through said barrel.

3. The method recited in claim 1, wherein said transition point is located from 12 mm to 80 mm from said muzzle.

4. The method recited in claim 1, wherein the length of said forcing cone is from 25 mm to 80 mm.

5. The method recited in claim 1, wherein said venting ports extend longitudinally along said barrel from said transition point toward said chamber for a distance from 25 mm to 160 mm.

6. The method recited in claim 1, wherein said venting ports are aligned in a plurality of substantially parallel rows in relation to a longitudinal axis extending along said barrel.

7. The method recited in claim 1, wherein the bore diameter between said forcing cone and said transition point is from 0.127 mm to 0.305 mm greater than the bore diameter of said muzzle.

* * * * *